US005233928A

United States Patent [19]

Ducros et al.

[11] Patent Number: 5,233,928

[45] Date of Patent: Aug. 10, 1993

[54] TELESCOPED AMMUNITION ROUND

[75] Inventors: Pierre Ducros, Pouilly-les-Nonains; Michel P. Giraudon, Henrichemont, both of France

[73] Assignee: GIAT Industries, France

[21] Appl. No.: 824,297

[22] Filed: Jan. 23, 1992

[30] Foreign Application Priority Data

Jul. 31, 1991 [FR] France ..... 91 09727

[51] Int. Cl.[5] ..... F42B 5/045

[52] U.S. Cl. ..... 102/434; 102/466; 102/467; 102/469

[58] Field of Search ..... 102/430, 433, 434, 464, 102/466, 467, 469

[56] References Cited

U.S. PATENT DOCUMENTS

| | | | |
|---|---|---|---|
| H61 | 5/1986 | Yuhash et al. | 102/434 |
| 3,935,816 | 2/1976 | Boquette, Jr. | 102/466 |
| 4,233,903 | 11/1980 | Lage | 102/466 |
| 4,770,098 | 9/1988 | Stoner | 102/434 |
| 4,846,068 | 7/1989 | Zedrosser | 102/466 |
| 4,848,237 | 7/1989 | Zedrosser | 102/466 |
| 4,938,145 | 7/1990 | Martwick | 102/434 |
| 5,063,852 | 11/1991 | Warren | 102/434 |

FOREIGN PATENT DOCUMENTS

| | | | |
|---|---|---|---|
| 767429 | 11/1971 | Belgium | 102/466 |
| 899552 | 6/1945 | France | 102/430 |
| 1114134 | 5/1968 | United Kingdom | 102/466 |

*Primary Examiner*—Harold J. Tudor

*Attorney, Agent, or Firm*—Parkhurst, Wendel & Rossi

[57] ABSTRACT

The invention relates to a telescoped ammunition round, comprising a case (2) made from plastic material made up of a cylindrical casing (3*a*, 3*b*) and two end caps (4*a*, 4*b*) disposed at opposite ends of the casing (3*a*, 3*b*). The case (2) is advantageously formed from two half-cases (2*a*, 2*b*) with each end cap (4*a*, 4*b*) forming a single piece moulded with the associated half-case (2*a*, 2*b*) and comprising axial expansion devices (12*a*, 12*b*).

6 Claims, 3 Drawing Sheets

FIG. 1
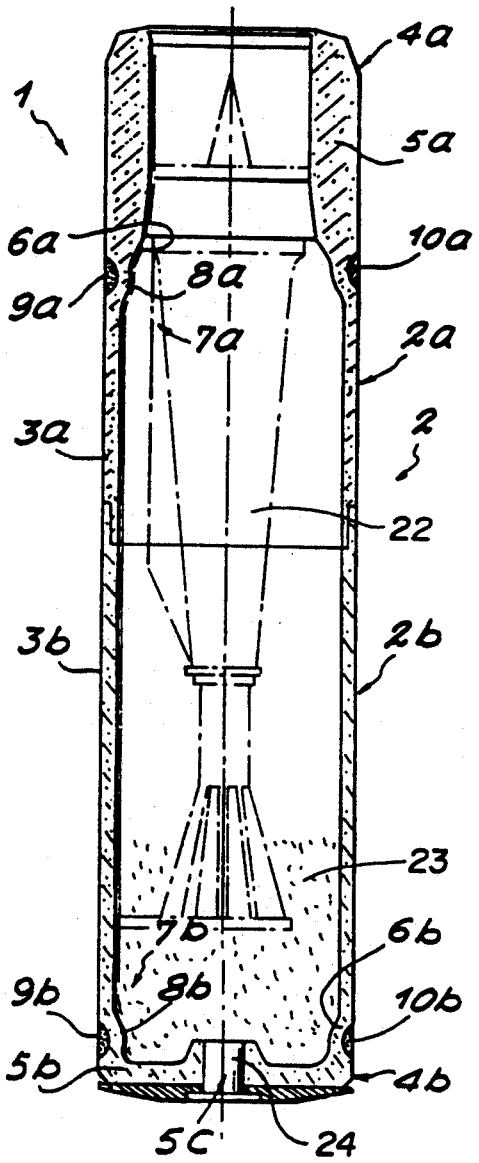
FIG. 2
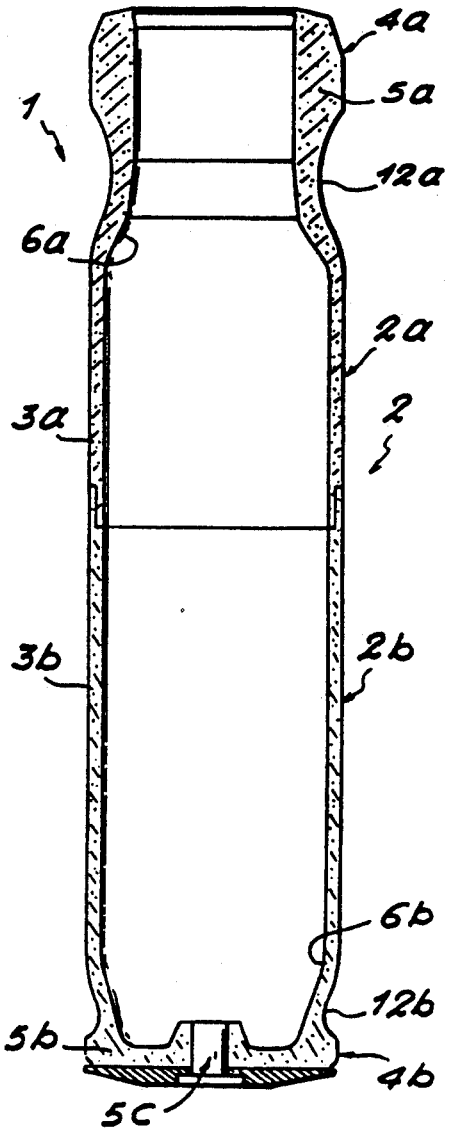
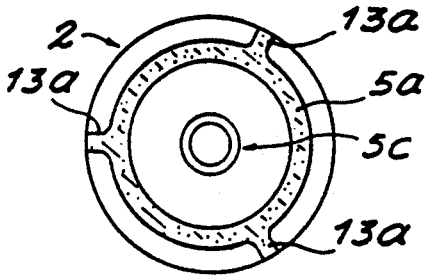
FIG. 2a

TELESCOPED AMMUNITION ROUND

The present invention relates to ammunition, in particular, a telescoped round, comprising a case made from a plastic material made up of a cylindrical casing and two end caps, one at the front end and the other at the rear end of the casing, a projectile and a propulsive charge housed inside the case and a device for igniting the propulsive charge.

Generally, telescoped ammunition whose front and rear end caps move under the effect of the pressure of the gases are designed so that they come into contact with the chamber of the barrel of a cannon when the propulsive charge is ignited. Ammunition in which the end caps are made from metal and attached at each end of the casing of the case is disclosed in U.S. Pat. No. 4,691,638. These end caps move under the effect of the pressure from the gases but are not able to extend past a stop piece carried by the casing of the case so that they remain attached thereto in order to facilitate extraction of the case after firing. In order to avoid any jamming inside the chamber, vents made in the casing are opened by the movement of the end caps.

The disadvantage of this design is the loss of containment of the gases and their coming into contact with the inside surface of the chamber (the blow torch effect), which results in its rapid deterioration.

In the ammunition disclosed in documents U.S. Pat. No. 4,907,510, U.S. Pat. No. 4,846,069 and EP-0 328 016, the casings and the end caps are also made from metal and elastic devices are provided to enable the cases to regain a size, after firing, that is suitable for them to be extracted from the chamber.

The use of plastic materials to make the ammunition case is also known, as the elasticity of these materials facilitates extraction from the case after firing. However, the expansion coefficients are such that they cause major variations in the length of the case (approximately 1% for the whole temperature range). It is in that case essential to provide sufficient axial play between the case and the chamber.

In the document U.S. Pat. No. 4,770,098, ammunition whose case is made from plastic material is disclosed. More precisely, the rear end cap, equivalent to the base of the ammunition, is moulded with the casing and the front end cap is press fitted in the free end of the case. However, the problems of the expansion of the case inside the chamber during the firing of the projectile are not mentioned. In fact, the increase in pressure inside the case when the ammunition is fired can cause the case to break at the rear end cap.

The object of the invention is to design ammunition of the telescoped type with a case made from plastic material designed differently and provided with devices that enable it, for example, to be able to expand axially when the ammunition is fired.

Therefore, the invention proposes a telescoped ammunition round with a case made from plastic material, which is characterized in that the case is made up of two components with at least one of the end caps, either front or rear, made from a single piece and moulded with the associated component, with this component being provided with axial expansion devices that are incorporated in the component.

According to a preferred embodiment of the invention, the two end caps are each moulded with the two components of the case, i.e. each component of the case is made up of a casing and an end cap to form a half-case, with both half-cases being connected to each other via their casings to form the case of the ammunition.

Generally, the front end cap of the case takes the form of a ring created by means of an excessive thickness inside the casing of the associated case component, with the internal wall of the ring being connected to the internal wall of the casing by means of a tapered surface. The rear end cap is in the form of a base also created by means of an internal excessive thickness of the casing of the associated component of the case, with the internal wall of the base being connected to the internal wall of the casing via a tapered part.

Examples of axial expansion devices will be given later, but generally they are located in the transition zone between the end caps and the casing, in the case and/or in the end caps themselves, since the casing of the case may adhere to the internal wall of the chamber of the barrel of the cannon after the propellant charge has been ignited. In other words, axial expansion of the case can only occur near to the front and rear end caps.

According to another characteristic of the invention, the axial expansion devices of the case are produced either by giving the case a special shape, i.e. without adding extra components, or directly by choosing a plastic material that has great elongation at rupture.

The two half-case configuration according to the aforementioned preferred embodiment of the invention also offers the advantage of facilitating loading of the ammunition. In fact, the projectile can be positioned in one half-case, and the propulsive charge may be inserted in each half-case, then the two half-cases may be assembled together.

As appropriate, a compressed charge may be adopted for one half-case and a pellet charge for the other half-case, or a compressed charge in each half-case. As a variant, two pellet charges may be used, but then at least one retaining ring shall be provided to enable the half-cases to be rigid with each other so as not to spill the charge. The ring shall preferably be made from a combustible material such as nitrocellulose or paper, or made from a material that fragments when fired.

Further advantages, features and details of the invention will emerge from the description which follows and from the accompanying drawings given solely as examples, in which:

FIG. 1 is an axial cross-sectional view of the case of a telescoped ammunition round conforming to the invention according to one embodiment;

FIG. 2 is an axial cross-sectional of the case of a telescoped ammunition round of another embodiment according to the invention;

Figure 3:
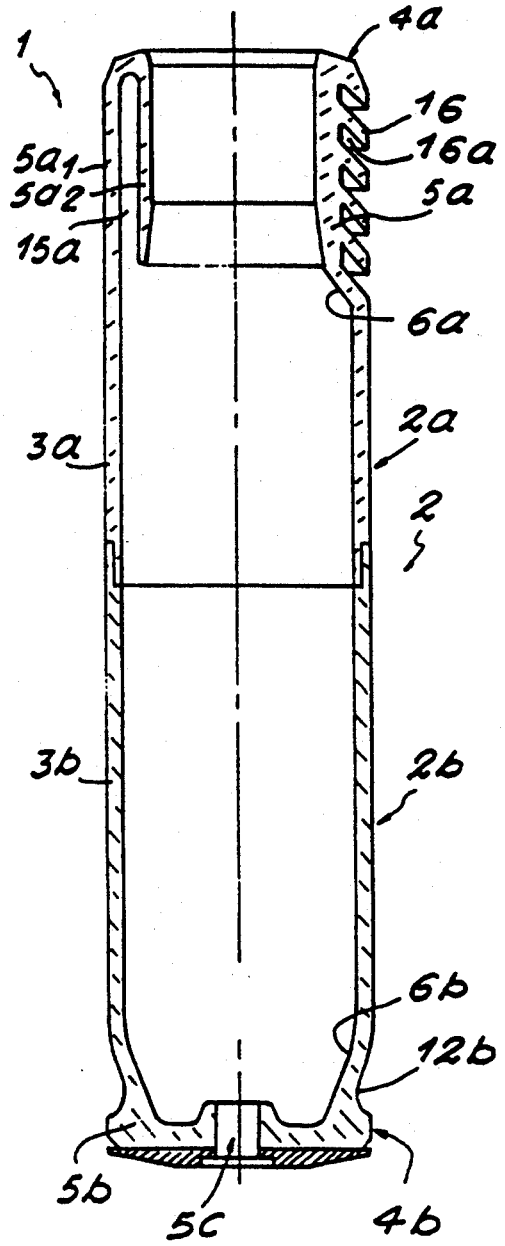
Figure 3A:
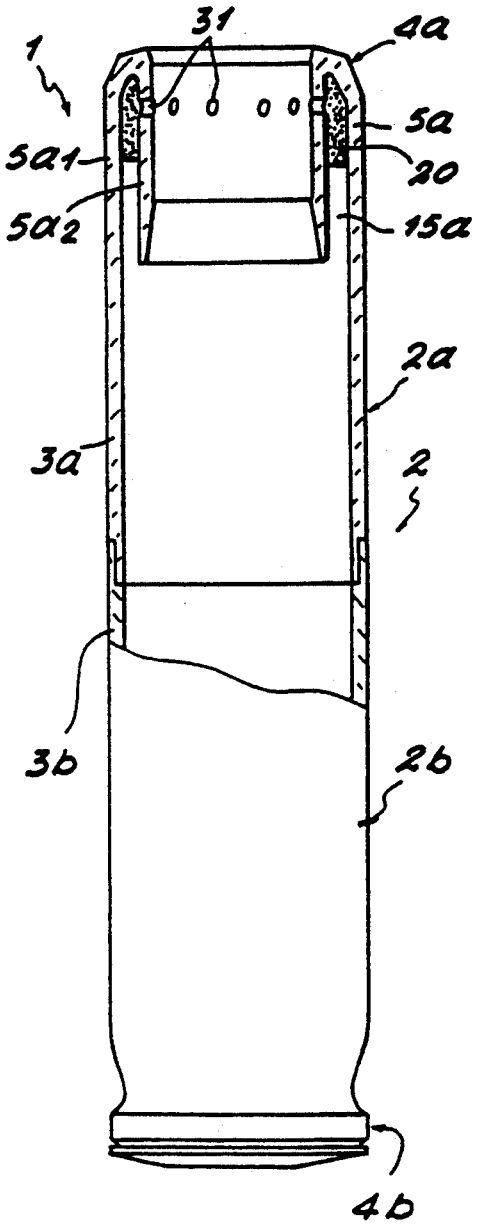
Figure 4:
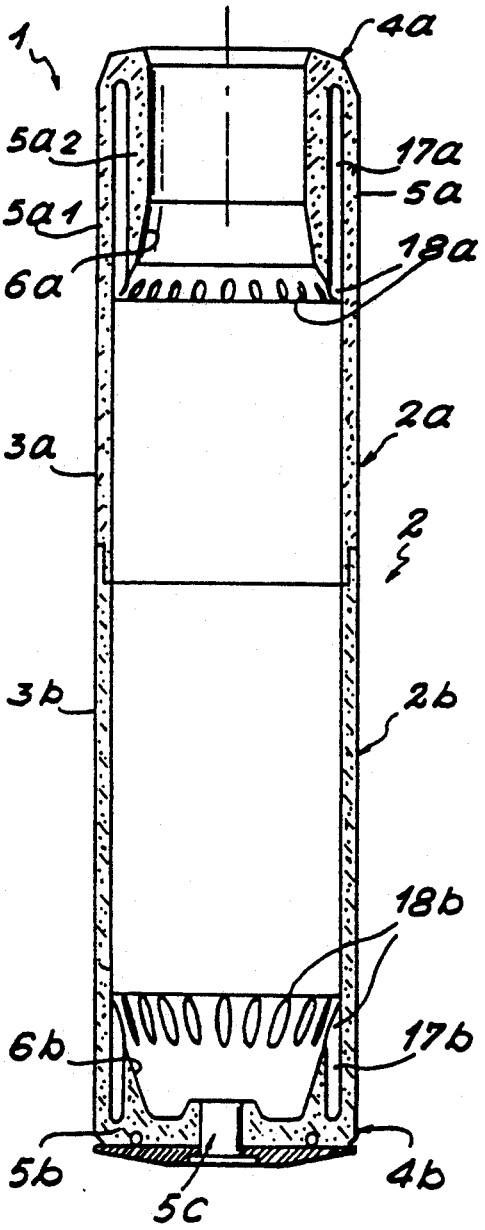
Figure 4A:
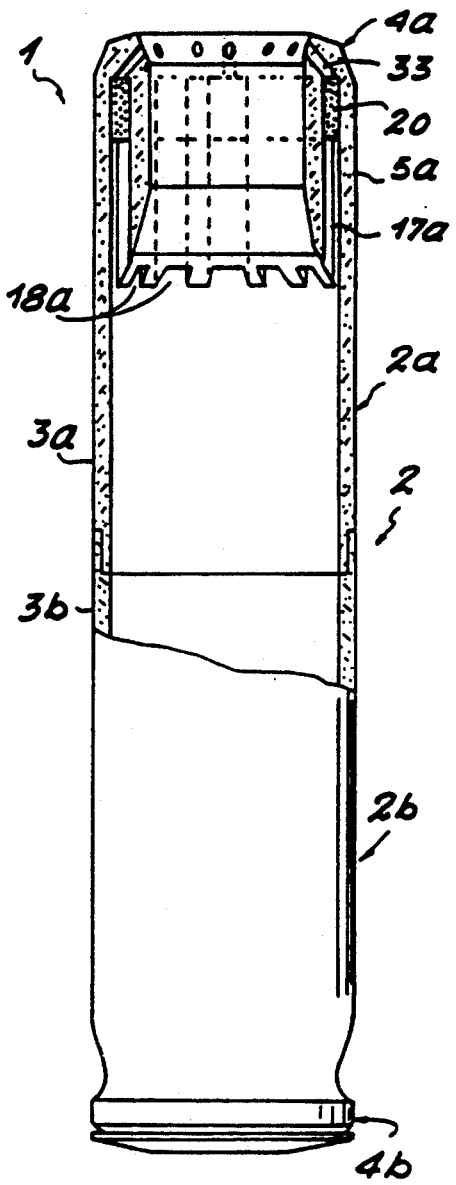

FIG. 2*a* is a transverse cross-sectional view of a variant of the embodiment of FIG. 2;

FIG. 3 is an axial cross-sectional view of the case of telescoped ammunition round according to the invention showing a different embodiment in each of the two views, a left hand view and a right hand view FIG. 3*a* is a partial axial cross-sectional view of the case of a telescoped ammunition round to show an improvement made to the embodiment to the left hand half view of FIG. 3;

FIG. 4 is a cross-sectional view to show another embodiment of the case of a telescoped ammunition round according to the invention;

and FIG. 4*a* is a partial axial cross-sectional view of the case of a telescoped ammunition round according to the invention showing an improvement made to the last embodiment of FIG. 4.

With reference to FIG. 1, the illustration of telescoped ammunition round 1 has been restricted to its case 2, is made up of two components, 2a and 2b made from plastic material, projectile 22, propulsive charge 23, and igniter 24.

In the following discussion, each of the two components will be deemed to constitute a half-case made up of a casing and an end cap.

The half-case 2a has a cylindrical casing 3a open at one end. At the other end of the casing 3a, the case 2a has a front end cap 4a in the form of a ring 5a moulded with the casing 3a. Ring 5a is located in the projection of the casing 3a and is formed by an increased thickness of the internal wall of the casing 3a. Generally, the internal wall of the ring 5a is connected to the internal wall of the associated casing 3a by means of a tapered part 6a.

The ring 5a is intended to house a projectile whose positioning is described, for example, in the documents FR-2 647 890 and FR-2 647 891.

The half-case 2b has a cylindrical casing 3b with a diameter equal to that of the casing 3a of the half-case 2a. This casing 3b is open at one end and closed at the other end with a rear end cap 4b in the form of a base 5b which constitutes a bottom wall of the casing 3b. Base 5b is moulded with the casing 3b. The internal wall of the base 5b is also connected to the internal wall of the casing 3b joined by means of a tapered part 6b.

The two half-cases 2a and 2b, axially aligned with their open ends opposite each other, are attached to each other using an appropriate method such as welding, for example, with partial overlapping of the two casings 3a and 3b when necessary. Of course, this joining operation is performed after the projectile and the propulsive charge have been positioned in the two half-cases 2a and 2b, as has already been previously described.

The base 5b is pierced with a central opening 5c in which an ignition device is mounted, by its nature already known and not shown, for the propulsive charge.

The two half-cases 2a and 2b also comprise axial expansion devices which will form the subject of several example embodiments disclosed below.

Referring still to FIG. 1, these axial expansion devices are made up of a special shape given to each half-case 2a and 2b. More precisely, in the example under consideration here, the surplus material in the half-case 2a results from an inward curve 7a of the casing 3a to form an internal annular bead 8a and an external annular groove 9a.

Preferably, this curve 7a is located in the transition area between the casing 3a and the associated end cap 4a. Similarly, the half-case 2b has a curve 7b located near to the rear end cap 4b and which demarcates an internal annular bead 8b and an external annular groove 9b.

The two curves 7a and 7b may be filled up with two rubber seals 10a and 10b respectively. These seals give the ammunition round 1 a smooth external appearance which facilitates the placing of the ammunition in the chamber of a weapon.

Once the ammunition is housed inside the chamber of the weapon, the priming of the propulsive charge produces pressure inside the half-cases 2a, 2b that thereby expanding radially and axially. While expanding radially, the casings 3a and 3b adhere to the internal wall of the chamber, which prevents any axial expansion there. On the other hand, the surpluses of material formed by the curves 7a and 7b located near the two ends of the half-cases 2a, and 2b enable them to expand axially. Without these surpluses, the result would be a rupture leading to a separation of the casings and the end caps, inhibiting removal of ammunition round from the case after the projectile has been fired.

Other embodiments hereinafter described disclosed which, like that of FIG. 1, are achieved by specially shaping the case.

According to an embodiment illustrated in FIG. 2, the axial expansion devices are formed in the semi case 2a from an annular groove 12a created in the external edge of the ring 5a. This groove 12a is advantageously located near the tapered part 6a which connects the ring 5a to the casing 3a. The edges of the groove 12a are flared so that the ammunition case does not catch on the inside of the chamber of the cannon barrel during insertion, and without it being necessary to fill up the groove 12a with a filling rubber.

As a variant of this embodiment, as shown in FIG. 2a, axial reinforcing ribs 13a may be provided inside the groove 12a to increase the flexural strength of the half-case 2a and also provide correct behaviour of the projectile inside the half-case 2a, without, however, adversely affecting the elongation of the half-case 2a.

Similar axial expansion devices are, for example, provided for the half-case 2b in the form of a groove 12b on the external edge of the base 5b.

According to the embodiment illustrated in the left hand half view of FIG. 3, the axial expansion devices are formed by an annular space 15a created in the ring 5a. This space 15a approximately extends over the entire length of the ring 5a and it opens into the inside of the casing 3a. Overall, the ring 5a is divided into two parts, an external annular part 5a1 which is an extension of the casing 3a having the same thickness thereof, and an internal annular part 5a2 which has approximately the same thickness as the part 5a1. With such a variant, the pressure of the gases may be felt across the space 15a near to the front face of the half-case 2a. Thus, the elongation of the half-case may be distributed over its entire length which avoids rupture occurring where the cap 4a and the casing 3a join.

According to the variant illustrated on the right hand half view of FIG. 3, the axial expansion devices are made up, in the ring 5a, of several annular grooves 16a on the outside of ring 5a, demarcated by surfaces that are approximately parallel to the tapered part 6a and separated by fins 16. These fins (16) give the half-case 2a an outer cylindrical shape and allow gradual radial deformation of the ring 5a in the annular grooves 16a when pressure increases, hence an axial deformation of the half-case. The configurations disclosed here with reference to FIG. 3, mean that it is possible to use a thickness of material that is approximately uniform, which ensures better homogeneity of the case when it is being injection moulded.

The axial expansion devices in the base 5b of half-case 2b are for example made up of a groove 12b as in the embodiment of FIG. 2. In fact and generally speaking, the axial expansion devices are not necessarily the same in the ring 5a and the base 5b. According to the embodiment illustrated in FIG. 4, the annular space 15a in the ring 4a of the half-case 2a corresponding to the preceding embodiment is replaced by parallel channels 17a having a circular cross section. Channels 17a each open out via an opening 18a into the inside of the casing 3a level with the tapered part 6a connecting the internal walls of the ring 5a and the casing 3a. It is thus possible to increase the strength of the internal part 5a2 of the ring 5a and to thus ensure that there is better support for the projectile inside the casing.

The axial expansion devices in the base 5b of the half-case 2b are for example also made up of parallel channels 17b which each open out via an opening 18b into the inside of the casing 3b connecting the internal walls of the base 5b and the casing 3b.

As a variant of this embodiment of FIG. 4a, the channels 17a may have a rectangular or oblong cross section in order to increase the surface area of the openings 18a and thus reduce the surface area of the tapered part 6a on which the pressure is going to be exerted. Thus the risks of rupture between the casing 3a and the ring 5a are reduced as pressure is increased inside the case after the propulsive charge has been ignited. These embodiments of FIGS. 4 and 4a are also very suitable for injection moulding since the thicknesses of the material may be approximately uniform.

In the embodiments of FIGS. 3a (left hand half view) and 4a, there is an anti-wear layer 20 incorporated in the half-case 2a such as a titanium dioxide and wax mixture in order to minimize wear of the chamber of the barrel of the cannon. This mixture is propelled out of the case by the pressure of the gases when the projectile is ejected.

In FIG. 3a, the mixture 20 is placed at the bottom of the space 15a made in the ring 5a, and openings 31 are made in the internal part 5a2 of the ring 5a in order to enable the mixture 20 to be propelled out of the case 2 by the pressure of the gases when the projectile is ejected from ammunition round 1, with the latter blocking these openings 31 when it is positioned inside the case of the round ammunition 1. If necessary, the space 15a is blocked up where it communicates with the inside of the half-case 2a, with a closing mat in order to prevent the mixture 20 from mixing with the propulsive charge.

In FIG. 4a, the mixture 20 is positioned at the bottom at each of the channels 17a of the ring 5a, and at the bottom of each of these channels 17a a sloping passage 33 is made 33 which opens to the outside and at the front of the ring 5a. These passages 33 are blocked up with a closure disk (not shown) attached at the front of the ring 5a, with this disk being ejected when the pressure increases. As in the example in FIG. 4a, a closure mat may be provided at the openings 18a through which the channels 17a open into the inside of the half-case 2a. As a variant, these passages 33 may be radial openings as in the case of FIG. 3a.

The materials used in the aforementioned variants are plastic materials of the thermoplastic type such as polycarbonates. Finally, if the plastic material used to make the two half-cases can allow elongation without rupture of the case, which requires a material that is relatively rigid in the service temperature range (−40° C., +60° C.) but which exhibits great elongation when submitted to high stresses during firing, it is then possible to eliminate the axial expansion devices disclosed above, with the characteristics alone of the plastic material making axial expansion of the case possible. A material of the elastomer thermoplastic type may be used. These materials are elastomers, that is, they are likely to deform under stress without any variation in volume and to virtually recover their initial dimensions when the stress is removed (in practice, their elongation at rupture is more than 300%). But they are termed thermoplastic because for reduced stresses, their tension/elongation curve is nearer to that of thermoplastics (such as polycarbonates) than that of traditional elastomers.

Amongst materials of this type, one may use for example polyurethane based copolymers (such as Estane or Desmopan, registered trademarks), polyester based copolymers (such as 1'Hytrel from Du Pont or 1'Arnitel from d'Akzo, registered trademarks) or polyamide copolymers (such as Dynil or Pebax from Atochem, registered trademarks).

Of course, the invention is not confined to the embodiments disclosed above, and it comprises any technical devices that are equivalent to those which have only been given as examples with reference to the appended drawings. In particular, a single ammunition round may have different axial expansion devices for each component forming its case, with these devices being chosen from those given as examples. A single ammunition round may have axial expansion devices according to the invention in only one of the components forming its case, with the other element being able to be designed differently. The separation between the two half-cases may be located nearer to or further away from the front and rear end caps. Finally, the case may comprise a half-case having a single front or rear end cap which can move under the effect of the pressure from the gases, and is rigid with a half-case which comprises expansion devices according to one of the embodiments disclosed above.

We claim:

1. A telescoped ammunition round, comprising:

a plastic case comprising a first cylindrical half-case integrally formed with a front end cap as one-piece and a second cylindrical half-case integrally formed with a rear end cap as one-piece, said cylindrical first and second half-cases being joined to each other;

a projectile and a propulsive charge disposed within said plastic case;

an ignition device disposed within said plastic case for igniting the propulsive charge; and a first axial expansion device provided between said first cylindrical half-case and said front end cap and a second axial expansion device provided between said second cylindrical half-case and said rear end cap, wherein said first and second axial expansion devices allow elongation of said ammunition round thereby avoiding rupture of said plastic case during firing.

2. The round of claim 1, wherein said front end cap comprises a ring defined by an increased wall thickness of said plastic case, said ring being connected to said casing by a tapered portion of said plastic case.

3. The round of claim 1, wherein said rear end cap comprises a base defined by an increased wall thickness of said plastic case, said base being connected to said casing by a tapered portion of said plastic case.

4. The round of claim 3, wherein said first and second axial expansion devices comprise extra plastic case material formed by an inwardly protruding annular bead, said bead defining an external annular groove.

5. The round of claim 4, further comprising a rubber seal formed in said external annular groove.

6. The round of claim 1, wherein said plastic case is made of a thermoplastic elastomer.

* * * * *